US006289898B1

(12) United States Patent
Fournier et al.

(10) Patent No.: US 6,289,898 B1
(45) Date of Patent: Sep. 18, 2001

(54) SMOKING ARTICLE WRAPPER WITH IMPROVED FILLER

(75) Inventors: Jay A Fournier, Richmond; John B. Paine, III, Midlothian, both of VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/399,159

(22) Filed: Sep. 20, 1999

Related U.S. Application Data

(63) Continuation-in-part of application No. 09/361,988, filed on Jul. 28, 1999.

(51) Int. Cl.[7] ..... A24B 1/00; D21H 11/00; D21F 11/00

(52) U.S. Cl. ..... 131/365; 131/360; 162/139

(58) Field of Search ..... 131/365, 360, 131/361, 362, 363, 349; 162/139, 158

(56) References Cited

U.S. PATENT DOCUMENTS

| | | | | |
|---|---|---|---|---|
| 2,673,565 | | 3/1954 | Schur et al. . | |
| 2,801,636 | | 8/1957 | Pfoh . | |
| 2,815,760 | | 12/1957 | Schreus et al. . | |
| 3,716,063 | | 2/1973 | Litzinger | 131/267 |
| 3,744,496 | * | 7/1973 | McCarty et al. | 131/365 |
| 3,878,853 | | 4/1975 | Lipson et al. | 131/262 A |
| 3,931,824 | | 1/1976 | Miano et al. | 131/2 |
| 4,129,134 | | 12/1978 | Hind et al. | 131/2 |
| 4,225,636 | | 9/1980 | Cline et al. | 427/243 |
| 4,231,377 | | 11/1980 | Cline et al. | 131/9 |
| 4,420,002 | | 12/1983 | Cline | 131/334 |
| 4,433,697 | | 2/1984 | Cline et al. | 131/365 |
| 4,450,847 | | 5/1984 | Owens | 131/365 |
| 4,607,646 | | 8/1986 | Lilly, Jr. et al. . | |
| 4,622,983 | | 11/1986 | Mathews et al. | 131/365 |
| 4,674,519 | | 6/1987 | Keritsis et al. . | |
| 4,805,644 | | 2/1989 | Hampl, Jr. et al. | 131/365 |
| 4,881,557 | | 11/1989 | Martin | 131/365 |
| 4,911,184 | | 3/1990 | Case et al. | 131/365 |
| 4,915,118 | | 4/1990 | Kaufman et al. | 131/365 |
| 4,924,888 | | 5/1990 | Perfetti et al. | 131/336 |
| 4,941,485 | | 7/1990 | Perfetti et al. | 131/365 |
| 4,941,486 | | 7/1990 | Dube et al. | 131/365 |
| 4,984,589 | | 1/1991 | Riedesser | 131/365 |
| 4,998,542 | | 3/1991 | Kallianos et al. | 131/365 |
| 4,998,543 | | 3/1991 | Goodman et al. | 131/365 |
| 5,060,674 | | 10/1991 | Brown et al. | 131/365 |
| 5,092,306 | | 3/1992 | Bokelman et al. | 131/365 |
| 5,103,844 | | 4/1992 | Hayden et al. | 131/365 |
| 5,105,837 | | 4/1992 | Barnes et al. | 131/365 |
| 5,121,759 | | 6/1992 | Dixit et al. | 131/365 |
| 5,131,416 | | 7/1992 | Gentry | 131/365 |
| 5,220,930 | | 6/1993 | Gentry | 131/365 |
| 5,228,463 | | 7/1993 | Fournier et al. | 131/365 |
| 5,450,862 | | 9/1995 | Baldwin et al. | 131/365 |
| 5,540,242 | | 7/1996 | Chao et al. | 131/365 |
| 5,692,525 | | 12/1997 | Counts et al. | 131/194 |

* cited by examiner

*Primary Examiner*—Stanley S. Silverman
*Assistant Examiner*—Dionne A. Walls
(74) *Attorney, Agent, or Firm*—Burns, Doane, Swecker & Mathis, LLP

(57) ABSTRACT

The invention relates to a tobacco smoking article wrapper which selectively reduces the content of gaseous components in the smoke delivered during the use of the smoking article. The gaseous components can be low molecular weight aldehydes in the smoke produced during combustion/pyrolysis of the smoking article. The wrapper can comprise cigarette paper having an ammonium-containing compound filler therein for reducing the aldehyde content in the smoke. The ammonium-containing compound filler evolves ammonia upon combustion/pyrolysis of the smoking article which can chemically react with aldehydes in tobacco smoke and/or modify the combustion/pyrolysis reactions thereby reducing the initial formation of aldehydes to selectively reduce such aldehydes from the smoke inhaled by a smoker. The ammonium-containing compound can be magnesium ammonium phosphate used alone or in combination with one or more other fillers such as calcium carbonate.

27 Claims, 2 Drawing Sheets

SMOKING ARTICLE WRAPPER WITH IMPROVED FILLER

This application is a CIP of Ser. No. 09/861,988 filed Jul. 28, 1999.

FIELD OF THE INVENTION

The present invention relates to smoking article wrappers. In particular, the invention relates to ammonium-containing compounds used as novel fillers in paper wrappers for smoking articles which are effective in selectively reducing the content of gaseous components, such as low molecular weight aldehydes, from the smoke produced during the use of such smoking articles.

BACKGROUND OF THE INVENTION

Paper wrappers for smoking articles are disclosed in U.S. Pat. Nos. 2,673,565; 2,801,636; 3,744,496; 3,931,824; 4,129,134; 4,225,636; 4,231,377; 4,420,002; 4,433,697; 4,450,847; 4,622,983; 4,805,644; 4,881,557; 4,911,184; 4,915,118; 4,924,888; 4,941,485; 4,941,486; 4,984,589; 4,998,542; 4,998,543; 5,060,674; 5,092,306; 5,105,837; 5,103,844; 5,121,759; 5,131,416; 5,220,930; 5,228,463; 5,450,862; and 5,540,242, the disclosures of which are hereby incorporated by reference.

Of the above patents, the '674 patent discloses adding monoammonium phosphate to cigarette paper as a burn modifier; the '543 patent discloses adding monoammonium phosphate to cigarette paper to reduce streaking of the outer paper due to condensation on the inside paper following puffs; the '837 patent discloses adding halides, sulfates and phosphates such as ammonium chloride, magnesium chloride, magnesium sulfate, mono-ammonium sulfate and disodium phosphate to cigarette paper as burn retardants; and the '242 patent discloses adding alginates including ammonium alginate to cigarette paper as a film forming additive to reduce sidestream smoke.

U.S. Pat. No. 2,815,760 discloses a tobacco smoke filter having an ion exchange material which chemically reacts with and retains carbonyl compounds such as aldehydes in the filter. U.S. Pat. No. 3,685,070 discloses a tobacco smoke filter containing the lipid soluble antioxidant N,N'-diphenyl-p-phenylenediamine (DDPD) for lowering the cytotoxic substances in the smoke. U.S. Pat. No. 3,716,063 discloses a tobacco smoke filter which selectively removes volatile aldehydes, the filter being a porous particulate material such as alumina impregnated with buffered poly(alkyleneimines). U.S. Pat. No. 3,878,853 discloses a cigarette filter containing a cationic component and a high molecular weight polyamine component for removal of ciliatoxic compounds from tobacco smoke.

While there have been proposals in the prior art for modifications to cigarette filters to remove aldehydes from mainstream smoke, such proposals lead away from the present invention wherein the wrapper of a tobacco smoking article is effective in reducing the content of gaseous components in mainstream smoke.

SUMMARY OF THE INVENTION

The invention provides a wrapper for a smoking article wherein tobacco is contained by the wrapper, the wrapper comprising a cellulosic web material and at least one filler therein, the filler being effective to selectively reduce the content of gaseous components in smoke produced by combustion/pyrolysis of the smoking article. According to a preferred embodiment, the wrapper comprises cigarette paper with an ammonium-containing compound filler in an amount effective to reduce aldehyde content in the smoke produced upon combustion/pyrolysis of the smoking article. The ammonium-containing compound filler is preferably an inorganic ammonium metal salt of low solubility such as magnesium ammonium phosphate. When used as a filler in the fabrication of wrappers for smoking articles, an amount equal to about 10% to about 60% of the final wrapper weight should be used, preferably about 20% to about 50% by weight based on the total weight of the wrapper.

In the smoking article wrappers of this invention ammonium-containing compounds may be used as the sole filler or may be mixed with other fillers known in the art. The filler can comprise two or more different ammonium-containing compounds. The wrapper can have a basis weight of between about 15 grams per square meter to about 75 grams per square meter, preferably a basis weight of between about 20 to about 50 grams per square meter, and a porosity of between about 2 CORESTA units to about 200 CORESTA units, preferably between about 10 CORESTA units to about 110 CORESTA units. The wrapper can include burn additives from about 2% to about 15% by weight based on the total weight of the wrapper. In addition, the wrappers of this invention may be a conventional one wrapper construction, a multiwrapped construction or a multilayer single wrap construction. Multiwrapped constructions or multilayered constructions might have different levels of ammonium-containing fillers. If desired, the wrapper is perforated and/or includes a film forming agent. In a preferred embodiment, the wrapper, comprising an ammonium-containing compound filler, is used to contain tobacco within a smoking article which upon combustion/pyrolysis leads to a reduction in the quantity of low molecular weight aldehydes in smoke.

DETAILED DESCRIPTION OF PREFERRED EMBODIMENTS

Figure 1:
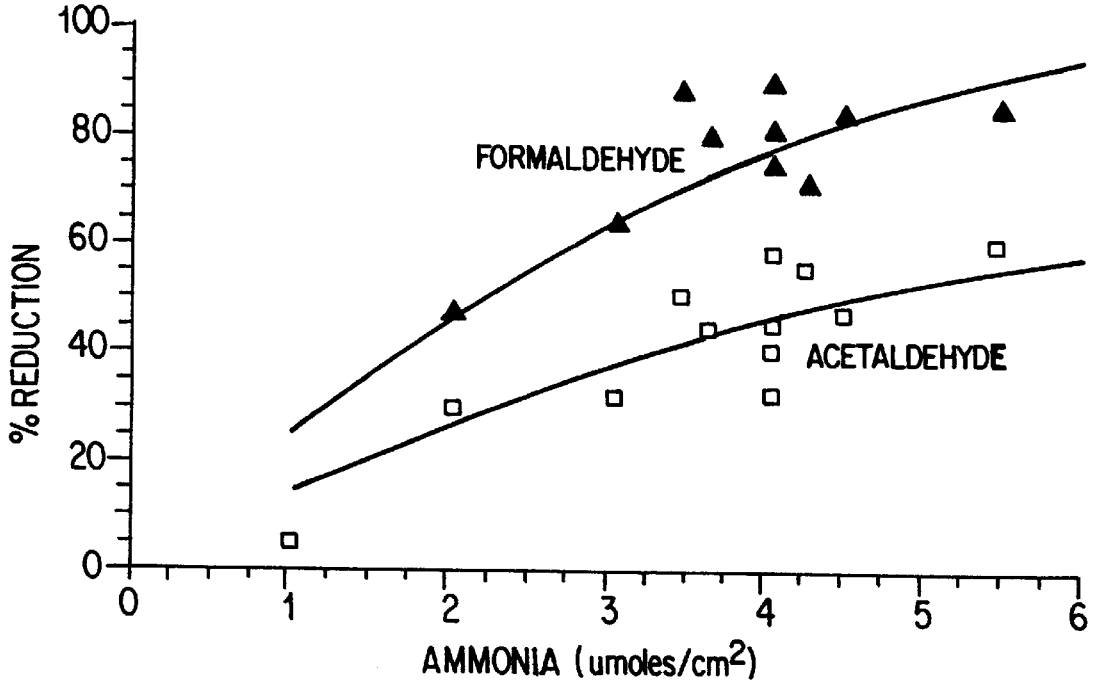
FIG. 1 is a graph of aldehyde reduction versus ammonia in magnesium ammonium phosphate containing cigarette papers in accordance with the invention.

According to the invention, a wrapper of a smoking article is provided wherein a filler of the wrapper is effective in reducing the content of gaseous components in the smoke produced by combustion/pyrolysis of the smoking article. The wrapper is preferably a paper wrapper wherein a filler in the paper wrapper is effective in reducing the content of aldehydes in mainstream tobacco smoke during combustion/pyrolysis of the smoking article.

The wrapper according to the invention can be manufactured by conventional papermaking processes wherein a filler, of low solubility, effective in reducing the content of gaseous components in smoke is added either by itself or as a mixture with other filler materials to an aqueous slurry containing cellulosic material.

According to a first aspect of the invention, fillers are proposed for wrappers of smoking articles wherein tobacco and tobacco-containing products are contained by the wrappers. As used herein the term tobacco includes not only cut tobacco leaf filler usually found in cigarettes, but also includes expanded tobacco, extruded tobacco, reconstituted tobacco, tobacco stems, tobacco substitutes, and synthetic tobacco, and blends thereof. A tobacco rod includes any substantially cylindrical, tobacco-containing smoking article, e.g., a cigarette.

In accordance with a first embodiment of the invention, the physical and chemical properties of the filler material used to produce smoking article wrappers are chosen and utilized to reduce the aldehyde content of the smoke produced during combustion/pyrolysis of the smoking article. According to a preferred embodiment, the paper filler includes an ammonium-containing compound which when heated evolves ammonia which may chemically react with aldehydes in tobacco smoke and/or modify the combustion/pyrolysis reactions thereby reducing the initial formation of aldehydes, thereby decreasing the delivery of such aldehydes to a smoker.

A preferred ammonium-containing compound is an inorganic ammonium metal salt such as an ammonium-alkaline earth metal salt such as $MgNH_4PO_4.xH_2O$ wherein x ranges from 1 to 6. It is preferred that the ammonium-containing compound have a low solubility in water so as to be compatible with conventional papermaking processes, e.g., the filler is substantially insoluble in an aqueous dispersion containing ingredients of the paper such as flax, etc. That is, the ammonium-containing compound should be stable enough in a papermaking process to survive intact as filler in the final paper product. This includes sufficient thermal stability to survive the drying steps in the papermaking process. Magnesium ammonium phosphate and its hydrates are well-suited to conventional papermaking processes, and evolve ammonia during the smoking process in a manner that greatly decreases the content of certain low molecular weight aldehydes in smoke. Magnesium potassium phosphate is isostructural with magnesium ammonium phosphate and can form solid solutions therewith. Such solid solutions are also effective for reducing the aldehyde content in smoke, although the best embodiments of the invention minimize the potassium content of such solid solutions.

The ammonium-containing compound filler can also comprise one or more of the following mineral phases: dittmarite, struvite, hannayite, schertelite, mundrabillaite and swaknoite.

Ammonium-containing compounds considered useful as filler materials have a range of surface areas, a range of particle sizes (mostly in the micron range), possess appropriate opacity, have low solubility in water (required for papermaking), and possess other properties that are considered desirable in fillers for cigarette papers. For purposes of a filler for cigarette paper, the filler preferably has a particle size below 25 $\mu$m, more preferably below 10 $\mu$m.

When used as filler in the fabrication of wrappers for smoking articles, a preferred amount of the ammonium-containing compound filler is equal to about 10% to about 60% of the final wrapper weight, more preferably about 20% to about 50% by weight. This percentage is referred to as the filler loading. The ammonium-containing compound can be the sole filler or it can be mixed with one or more other fillers in the paper. In the case of mixtures, a portion, e.g., up to 60% by weight, of the filler loading can comprise one or more inorganic carbonate, inorganic hydroxide, inorganic oxide, or inorganic phosphate. Examples of such fillers include, e.g., calcium carbonate, magnesium hydroxide, magnesium oxide, magnesium carbonates, and titanium dioxide as well as other fillers known in the art.

The wrappers containing the fillers of the invention can have a basis weight of between about 15 to about 75 grams per square meter and can have a porosity of between about 2 to about 200 cubic centimeters per minute per square centimeter as measured by the CORESTA method ("CORESTA units"). The most preferred basis weight is between about 20 to about 50 grams per square meter and the most preferred porosity is between about 10 to about 110 CORESTA units.

Burn additives such as alkali metal salts of carboxylic acids or phosphoric acids can be applied to the wrapper to adjust or control the burn rate of the resulting smoking article. For example, burn additives can be applied in amounts ranging from about 2% to about 15% by weight of the wrapper. Examples of burn additives include sodium fumarate, sodium citrate, potassium citrate, potassium succinate, potassium monohydrogen phosphate, and potassium dihydrogen phosphate.

To prepare wrappers containing the fillers of the invention, conventional cigarette papermaking procedures are used with the inclusion of an ammonium-containing compound filler in accordance with the invention in place of or in combination with a conventional cigarette paper filler such as calcium carbonate. The paper wrappers may be made from flax, wood pulp, or other plant fibers. In addition, the paper wrappers may be a conventional one wrapper construction, a multiwrapped construction or a multilayer single wrap construction.

In order to demonstrate the practice and beneficial results of this invention several cigarette paper compositions were prepared with different fillers and varying total filler weight per square meter of paper. The total filler weight per square meter of paper is controlled by adjusting the filler loading and/or the basis weight (thickness) of the paper. Examples of both handmade papers and machine-made papers as well as handmade cigarettes and machine-made cigarettes are included. The cigarette construction used was that of a less traditional design shown in FIG. 3 wherein the cigarette is useable with an electronic smoking device as described in U.S. Pat. No. 5,692,525, the entire content of which is hereby incorporated by reference. Formaldehyde and acetaldehyde levels in mainstream smoke of cigarettes prepared using the paper wrappers of this invention as the outer paper wrap (71) of the cigarette were analyzed using a whole smoke method and compared, using the same smoking conditions, to control cigarettes of the same construction using an outer paper wrap containing about 35% by weight calcium carbonate at a basis weight of 28 $g/m^2$ and a porosity of 46 CORESTA. Table 1 lists different cigarette samples with paper descriptions including filler, filler level, basis weight, porosity and the amount of ammonia available per square centimeter of paper, and the percent reduction in the content of formaldehyde and acetaldehyde in the mainstream smoke for each cigarette versus its control. As shown in Table 1, use of the ammonium-containing compound magnesium ammonium phosphate as the filler in the cigarette papers surprisingly and unexpectedly produced reduction in the content of formaldehyde in mainstream smoke of up to 91%.

TABLE 1

| | Outerwrap Paper | | | | | % Reduction In Mainstream Smoke* | |
|---|---|---|---|---|---|---|---|
| Cigarette Sample | Filler | Filler % | Basis Wt. ($g/m^2$) | Porosity (COESTA) | Ammonia ($\mu moles/cm^2$) | Formaldehyde | Acetaldehyde |
| 1 | $MgNH_4PO_4 \cdot 6H_2O$ | 40 | 25 | 25 | 4.1 | 91% | 59% |
| 2 | 25% 75% $CaCO_3$ | 40 | 25 | 25 | 1.0 | no | 5% |
| 3 | 50% $MgNH_4PO_4 \cdot 6H_2O$ 50% $CaCO_3$ | 40 | 25 | 24 | 2.0 | 48% | 30% |
| 4 | 75% $MgNH_4PO_4 \cdot 6H_2O$ 25% $CaCO_3$ | 40 | 25 | 24 | 3.1 | 64% | 32% |
| 5 | $MgNH_4PO_4 \cdot 6H_2O$ | 40 | 25 | 20 | 4.1 | 91% | 33% |
| 6 | $19MgNH_4PO_4 \cdot 5MgKPO_4 \cdot xH_2O$ | 30 | 35 | 27 | 3.7 | 81% | 45% |
| 7 | $19MgNH_4PO_4 \cdot 5MgKPO_4 \cdot xH_2O$ | 40 | 25 | 27 | 3.5 | 89% | 51% |
| 8 | $MgKPO_4 \cdot 6H_2O$ | 30 | 35 | 29 | 0.0 | 27% | 43% |
| 9 | $MgHPO_4 \cdot 3H_2O$ | 40 | 25 | 31 | 0.0 | 42% | 42% |
| 10 | $MgNH_4PO_4 \cdot xH_2O$ | 40 | 25 | 45 | 4.1 | 76% | 46% |
| 11 | $MgNH_4PO_4 \cdot xH_2O$ | 30 | 35 | 27 | 4.3 | 72% | 56% |
| 12 | $MgNH_4PO_4 \cdot xH_2O$ | 40 | 25 | 45 | 4.1 | 82% | 41% |
| 13 | $19MgNH_4PO_4 \cdot 5MgKPO_4 \cdot xH_2O$ | 34 | 47 | 80 | 5.5 | 87% | 61% |
| 14 | $Mg(NH_4)_{0.95}K_{0.05}PO_4 \cdot xH_2O$ | 30 | 37 | 55 | 4.5 | 85% | 48% |
| 15 | $Mg(NH_4)_{0.95}K_{0.05}PO_4 \cdot xH_2O$ | 35 | 45 | 24 | 6.4 | 90% | 57% |
| 16 | Albacar $CaCO_3$ | 30 | 37 | 29 | 0.0 | no reduction | 11% |

*Values listed for each sample are the average of three cigarettes smoked with an electronic smoking device using comparable energies.

FIG. 1 is a graph of formaldehyde and acetaldehyde reduction versus available ammonia ($\mu moles/cm^2$ of paper) in magnesium ammonium phosphate containing cigarette papers in accordance with the invention. As shown in FIG. 1, the percent reduction in the content of formaldehyde and acetaldehyde in mainstream smoke increases with an increase in available ammonia (generated from the heating of the magnesium ammonium phosphate paper filler) per unit area of paper. Surprisingly, with increasing levels of magnesium ammonium phosphate filler (available ammonia) the formaldehyde levels decrease at a faster rate than do the acetaldehyde levels. It is believed, based on thermogravimetric/mass spectroscopy data, that only ammonia and water are released from the magnesium ammonium phosphate filler during combustion/pyrolysis of the paper and that both chemistry and thermodynamics are responsible for reducing the aldehyde content in smoke. The released ammonia can affect the aldehyde content of the generated smoke by a number of mechanisms, which could operate either independently or simultaneously. While not wishing to be bound by theory, we believe that among possible mechanisms which may be responsible for reducing the aldehyde content is a chemical reaction between the ammonia and aldehyde gases, the reaction product(s) of which may be less volatile and condensed/trapped in the ashes, rod, and/or filter of the cigarette. Another possibility is that a change in the temperatures of combustion/pyrolysis and/or the presence of ammonia in the combustion/pyrolysis environment may ultimately affect the initial formation of the aldehydes produced during the smoking process.

Figure 2:
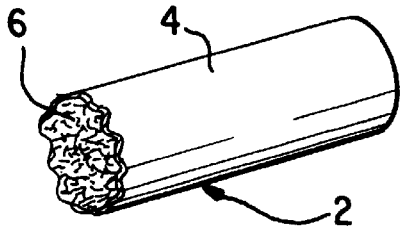
FIG. 2 is a perspective view of a traditional cigarette having a single wrapper in accordance with the invention.
Figure 3:
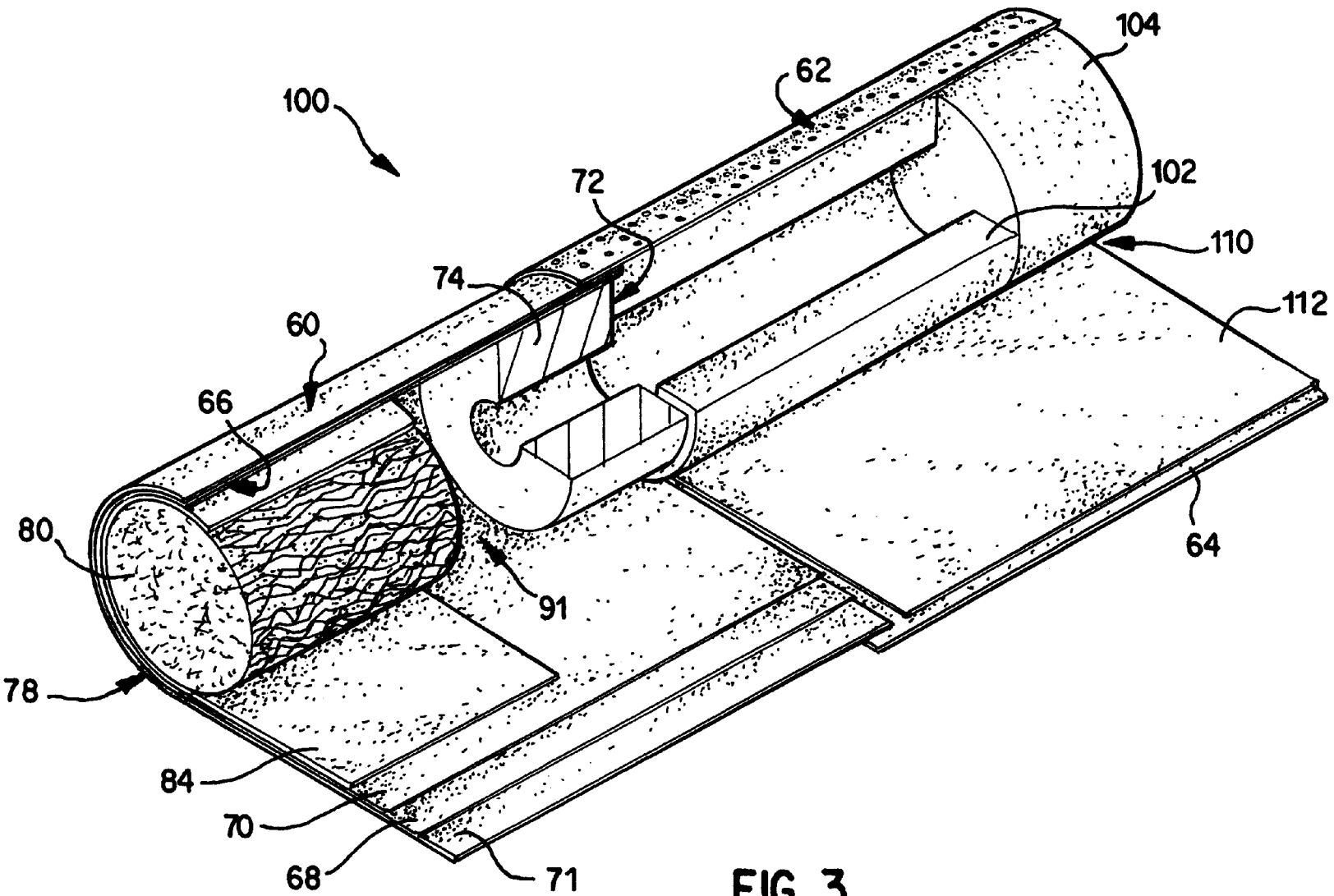
FIG. 3 is a perspective view of a less traditional cigarette having more than one wrapper in accordance with the invention.

A cigarette wrapper in accordance with the invention can have any desired configuration and/or one or more layers of fiber such as paper and/or tobacco incorporating a filler effective in reducing the content of aldehydes. For instance, the cigarette wrapper 2 can be a single layer 4 surrounding a tobacco rod 6, as shown in the partial sectional view of FIG. 2. A less traditional cigarette wrapper is shown in FIG. 3 wherein the cigarette is useable with an electronic smoking device as described in U.S. Pat. No. 5,692,525. FIG. 3 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web or mat 66comprising a base web 68 and tobacco 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. The tobacco rod can comprise tobacco, tobacco blends, tobacco substitutes, etc. The filler in accordance with the invention can be incorporated in one or more of the layers 71, 84, 68, 70 or 66.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. A wrapper for a smoking article wherein tobacco is contained by the wrapper, the wrapper comprising a cellulosic web material and at least one filler therein, the at least one filler comprising an ammonium-containing compound filler the filler being effective to reduce the content of one or more gaseous components in the smoke produced upon combustion/pyrolysis of the smoking article.

2. The wrapper according to claim 1, wherein the filler includes an inorganic compound selected from the group consisting of inorganic carbonates, inorganic hydroxides, inorganic oxides, and inorganic phosphates.

3. The wrapper according to claim 1, wherein the filler ranges from about 10% to about 60% by weight based on the total weight of the wrapper.

4. The wrapper according to claim 1, wherein the wrapper comprises cigarette paper having a single layer or multilayers.

5. The wrapper according to claim 1, having a basis weight of between about 15 $g/m^2$ to about 75 $g/m^2$, and a porosity of between about 2 CORESTA units to about 200 CORESTA units.

6. The wrapper according to claim 1, having a basis weight of between about 20 $g/m^2$ to about 50 $g/m^2$, and a porosity of between about 10 CORESTA units to about 110 CORESTA units.

7. The wrapper according to claim 1, wherein the wrapper includes from about 2% to about 15% by weight of a burn additive.

8. The wrapper according to claim 7, wherein the burn additive is an alkali metal salt of an acid.

9. The wrapper according to claim 8, wherein the alkali metal salt of an acid is at least one member selected from the group consisting of sodium fumarate, sodium citrate, potassium citrate, potassium succinate, potassium monohydrogen phosphate, and potassium dihydrogen phosphate.

10. The wrapper according to claim 1, wherein the wrapper comprises cigarette paper and the cellulosic material comprises plant fibers.

11. The wrapper according to claim 1, wherein the wrapper comprises cigarette paper surrounding a rod of cigarette tobacco.

12. The wrapper according to claim 1, wherein the gaseous component whose content is reduced by the presence of the filler during combustion/pyrolysis of the smoking article includes at least one low molecular weight aldehyde.

13. The wrapper according to claim 1, wherein the wrapper is perforated and/or includes a film forming agent.

14. A wrapper for a smoking article wherein tobacco is contained by the wrapper, the wrapper comprising a cellulosic web material and at least one filler therein, the filler being effective to reduce the content of gaseous components in the smoke produced upon combustion/pyrolysis of the smoking article, wherein the filler includes an ammonium-containing compound filler in an amount effective to reduce aldehyde content in the mainstream smoke produced upon combustion/pyrolysis of the smoking article.

15. The wrapper according to claim 14, wherein the ammonium-containing compound filler is magnesium ammonium phosphate or one o f its hydrates.

16. The wrapper according to claim 14, wherein the ammonium-containing compound filler is an inorganic ammonium metal salt.

17. The wrapper according to claim 14, wherein the amount of the ammonium-containing compound ranges from about 20% to about 50% by weight based on the total weight of the wrapper.

18. The wrapper according to claim 14, wherein the ammonium-containing compound filler is a solid solution of magnesium ammonium phosphate and magnesium potassium phosphate or any of their respective hydrates.

19. The wrapper according to claim 14, wherein the ammonium-containing compound filler comprises at least one of the mineral phases dittmarite, struvite, hannayite, schertelite, mundrabillaite and swaknoite.

20. The wrapper according to claim 14, wherein the ammonium-containing compound filler includes at least two different ammonium-containing compounds.

21. A cigarette comprising a tobacco rod contained by a paper wrapper and an optional filter at one end of the cigarette, the paper wrapper comprising a cellulosic web material and at least one filler therein, the at least one filler comprising an amnonium-containing compound filler the filler being effective to reduce the content of one or more gaseous components in the smoke produced by combustion/pyrolysis of the cigarette.

22. A cigarette comprising a tobacco rod contained by a wrapper and an optional filter at one end of the cigarette, the paper wrapper comprising a cellulosic web material and at least one filler therein, the filler being effective to reduce the content of gaseous components in the smoke produced by combustion/pyrolysis of the cigarette, wherein the filler includes an ammonium-containing compound filler in an amount effective to reduce aldehyde content in the mainstream smoke produced upon combustion/pyrolysis of the cigarette.

23. The cigarette according to claim 22, wherein the ammonium-containing compound filler consists essentially of magnesium ammonium phosphate and/or calcium ammonium phosphate.

24. A cigarette comprising a tobacco web surrounding a tobacco rod, a paper wrapper surrounding the tobacco web, and an optional filter at one end of the cigarette, the paper wrapper comprising a cellulosic web material and at least one filler therein, the at least one filler comprising an ammonium-containing compound filler the filler being effective to reduce the content of one or more gaseous components in mainstream smoke produced by combustion/pyrolysis of the cigarette.

25. A cigarette comprising a tobacco web surrounding a tobacco rod, a paper wrapper surrounding the tobacco web, and an optional filter at one end of the cigarette, the paper wrapper comparing a cellulosic web material and at least one filler therein, the filler being effective to reduce the content of gaseous components in mainstream smoke produced by combustion/pyrolysis of the cigarette, wherein the filler includes an ammonium-containing compound filler in an amount effective to reduce aldehyde content in the mainstream smoke produced upon combustion/pyrolysis of the cigarette.

26. A web comprising a cellulosic web material and a filler, at least a portion of said filler consisting essentially of magnesium ammonium phosphate and/or calcium ammonium phosphate.

27. A cigarette comprising a tobacco web surrounding a tobacco rod, a paper wrapper surrounding the tobacco webs arid an optional filter at one end of the cigarette, the tobacco web comprising tobacco and at least one filler therein, the at least one filler comprising an ammonium-containing compound filler the filler being effective to reduce the content of one or more gaseous components in mainstream smoke produced by combustion/pyrolysis of the cigarette.

* * * * *